United States Patent [19]

Hulsbergen et al.

[11] Patent Number: 5,022,262

[45] Date of Patent: Jun. 11, 1991

[54] PROCESS AND APPARATUS FOR DETERMINING THE ERODABILITY OF SOIL, IN PARTICULAR SOIL BELONGING TO THE UNDERWATER FLOOR

[75] Inventors: Cornelis H. Hulsbergen, Dollardstraat 5, 8303 LG Emmeloord; Romke Bijker, Koningsdam 1, 3011 TN Rotterdam, both of Netherlands

[73] Assignees: Cornelis H. Hulsbergen; Romke Bijker, both of Netherlands

[21] Appl. No.: 389,272

[22] Filed: Aug. 3, 1989

[30] Foreign Application Priority Data

Aug. 9, 1988 [NL] Netherlands ..... 8801989

[51] Int. Cl.[5] ..... G01W 1/00

[52] U.S. Cl. ..... 73/170 A

[58] Field of Search ..... 73/170 A, 152

[56] References Cited

U.S. PATENT DOCUMENTS 3,690,166 9/1972 Grice ..... 73/152

3,774,718 11/1973 Igarashi et al. ..... 73/170 A

FOREIGN PATENT DOCUMENTS 335101 9/1930 United Kingdom .

OTHER PUBLICATIONS

Patent Abstracts of Japan, vol. 10, No. 55 (M-458) (2112), Mar. 5, 1986.

Patent Abstracts of Japan, vol. 7, No. 211 (M-243) (1356), Sept. 17, 1983.

*Primary Examiner*—Donald O. Woodiel

*Attorney, Agent, or Firm*—Rosen, Dainow & Jacobs

[57] ABSTRACT

To determine the erodability of soil, in particular soil belonging to the underwater floor, a vertically displaceable spray nozzle is installed above the floor to produce a water flow onto or over the floor soil. The water flow forms a pit in the soil by erosion. The spray nozzle is systematically lowered by means of displacement means in a manner such that the nozzle follows the descending pit floor. The speed at which the spray nozzle follows the pit floor is determined and the erodability is derived at various depths from the relationship between this speed and the flow rate of the water flow. To obtain an accurate and reproduceable determination of the erodability a quantity, which is a function of the distance between the bottom end of the spray nozzle and the floor of the pit, is measured with a sensor fitted to the spray nozzle. This quantity is used to regulate a servo system which controls the displacement means of the spray nozzle in a manner such that the distance between the bottom end of the spray nozzle and the floor of the pit remains essentially constant.

9 Claims, 3 Drawing Sheets

PROCESS AND APPARATUS FOR DETERMINING THE ERODABILITY OF SOIL, IN PARTICULAR SOIL BELONGING TO THE UNDERWATER FLOOR

BACKGROUND OF THE INVENTION

1. Field of the Invention

The invention relates in the first instance to a process for determining the erodability of soil, in particular soil belonging to the underwater floor, comprising installing a vertically displaceable spray nozzle above the floor, producing a water flow onto or over the floor by means of said spray nozzle, which flow forms a pit in the soil by erosion of the soil, systematicly lowering the spray nozzle by means of displacement means in a manner such that said nozzle follows the descending pit floor, determining the speed at which the spray nozzle follows the pit floor and deriving the erodability at various depths from the relationship between said speed and the flow rate of the water flow.

2. Description of the Prior Art

Such a process is known from the U.S. Pat. No. 3,690,166.

Offshore structures such as pipelines and drilling platforms are in many cases sited on fine-grained sedimentary material. Said sediment may be eroded by wave and flow action, that is to say, the grains are detached and entrained by the water. This erosion may have not only disadvantageous but also advantageous consequences. The washing away of soil near supporting pillars of platforms and the like can result in dangerous situations; on the other hand, the self-burying of pipes lying on the sea floor is an example of a desired consequence of erosion. In planning and designing structures having a foundation in the underwater floor account will therefore have to be taken of the erodability of the soil. There is therefore a need for a method and an apparatus for predicting and measuring the erodability of the soil with adequate accuracy and reproducibility. The extent to which the soil is eroded depends on the (variable) flow and wave action and on (the variation in) the soil characteristics in the horizontal and vertical direction.

Some known methods of predicting the erosion of soil exposed to wave and flow action are subject to disadvantages. They are based either on determining in situ the cone resistance, the imperviousness and the permeability of the soil, or on determining characteristics of soil samples in the laboratory, such as the composition and the grain size distribution and the erodability when exposed to a water flow. However, these methods either give only indirect low-reliability information on the erodability of the soil or the methods are very cumbersome and therefore expensive. The indirect interpretation of the data is particularly difficult if the floor contains cohesive material such as silt. This is the case in large parts of, for example, the North Sea. In addition, it is usually inadequate to examine one sample at a site, because the characteristics generally vary layer-wise and in the horizontal direction.

In the method according to said U.S. Pat. No. 3,690,166, the spray nozzle is suspended on a cable which is wound over a drum to be actuated by a motor. The tension in the cable is determined by load cells and said cells regulate the electrical energy delivered to the motor so that the cable tension remains essentially constant. Owing to differences in cable characteristics (length, stiffness) and the like this method is too inaccurate to achieve a constant distance between the spray nozzle and the floor of the small pit. Small variations in distance between the bottom of the spray nozzle and the floor of the small pit have considerable consequences in relation to the measured erodability. A constant distance is therefore necessary to obtain accurate and reproducible erodability measurement results. The known method is therefore also unsuitable in particular for determining small variations in erodability under relatively weak water flows.

The object of the invention is to avoid the disadvantages mentioned of known methods .and to provide a process of the type mentioned in the preamble with which the erodability of soil can be accurately and reproducibly determined.

SUMMARY OF THE INVENTION

According to the invention, a quantity which is a function of the distance between the bottom end of the spray nozzle and the floor of the pit is measured with a sensor fitted to the spray nozzle and said quantity is used to regulate a servo system which controls said displacement means of the spray nozzle in a manner such that said distance between the bottom end of the spray nozzle and the floor of the pit remains essentially constant.

Because a water flow is produced onto or over the soil, which flow forms a pit by erosion of the soil, the method largely corresponds to the actual conditions which may occur in the case of an offshore structure, because the floor particles are detached and transported by a water flow. Essential to the invention is that the distance between the bottom end of the spray nozzle and the floor of the pit is kept constant by adding a sensor and a servo system.

It should also be possible to keep the rate of flow of the water flow constant; it is, however, preferable to make said rate of flow regulable. In that case, the relationship can be determined between the speed with which the floor of the pit descends and the associated rate of flow of the water flow, and the erodability of the soil at various depths can be derived from said relationship. The possibility exists of keeping the speed at which the spray nozzle descends constant by varying the rate of flow. The varying rate of flow is then a measure of the erodability of the soil at various depths. In general, however, it is more practical to keep the rate of flow of the water flow constant and to determine the speed at which the water supply means follow the floor of the pit in a controlled manner. The rate of descent of the spray nozzle is then a measure of the erodability of the soil at various depths.

The invention furthermore relates to an apparatus for determining the erodability of soil, in particular soil belonging to the underwater floor, comprising a spray nozzle, displacement means for displacing the nozzle vertically, control means for systematically controlling the displacement means in a manner such that the spray nozzle is able to follow the descent of the floor of the pit, and means for determining the speed at which the spray nozzle follows the descending pit floor. Said apparatus is characterized in that a sensor for measuring a quantity which is a function of the distance between the bottom end of the spray nozzle and the floor of the pit is fitted to the spray nozzle, which sensor is connected to a servo system which is capable of controlling hydraulic or mechanical means for displacing a suspension bar of the spray nozzle in a manner such that the distance between the bottom end of the spray nozzle and the floor of the pit remains essentially constant.

Preferably, the apparatus also comprises means for measuring and regulating the flow rate of the water flow through the spray nozzle.

There are various possibilities for the sensor mentioned. A sensor is preferred which comprises a mechanical feeler which projects displaceably into the spray nozzle, position-determining means being present in the nozzle for determining the position of the feeler in the spray nozzle.

For these last mentioned position-determining means, various possibilities again exist, for example, using an electromagnetic field, a radar or a laser. It is preferable, however, to connect the feeler to the spray nozzle by springs and attach strain gauges to the springs for determining the spring tension, which is a function of the position of the feeler in the spray nozzle. In another structure, the sensor comprises a so-called dynamic profile tracer. This is a bar having two feeler electrodes sited at a short distance above one another and a common main electrode, means being present for determining the electrical resistance between the main electrode and the feeler electrodes.

The measurement of the erodability is carried out more in accordance with the actual conditions if the spray nozzle is T-, L-or U-shaped and has a vertical water feed, possibly having a vertical water drain and an open horizontal intermediate section where the main erosion process takes place under the influence of horizontal flow.

There is the possibility of providing the spray nozzle with turbulence-promoting devices. An example of this is the blowing of air into the water flow shortly before the water emerges from the spray nozzle.

The invention will now be explained in more detail with reference to the figures in which a number of exemplary embodiments are diagrammatically shown.

DESCRIPTION OF THE PREFERRED EMBODIMENT

Figure 1:
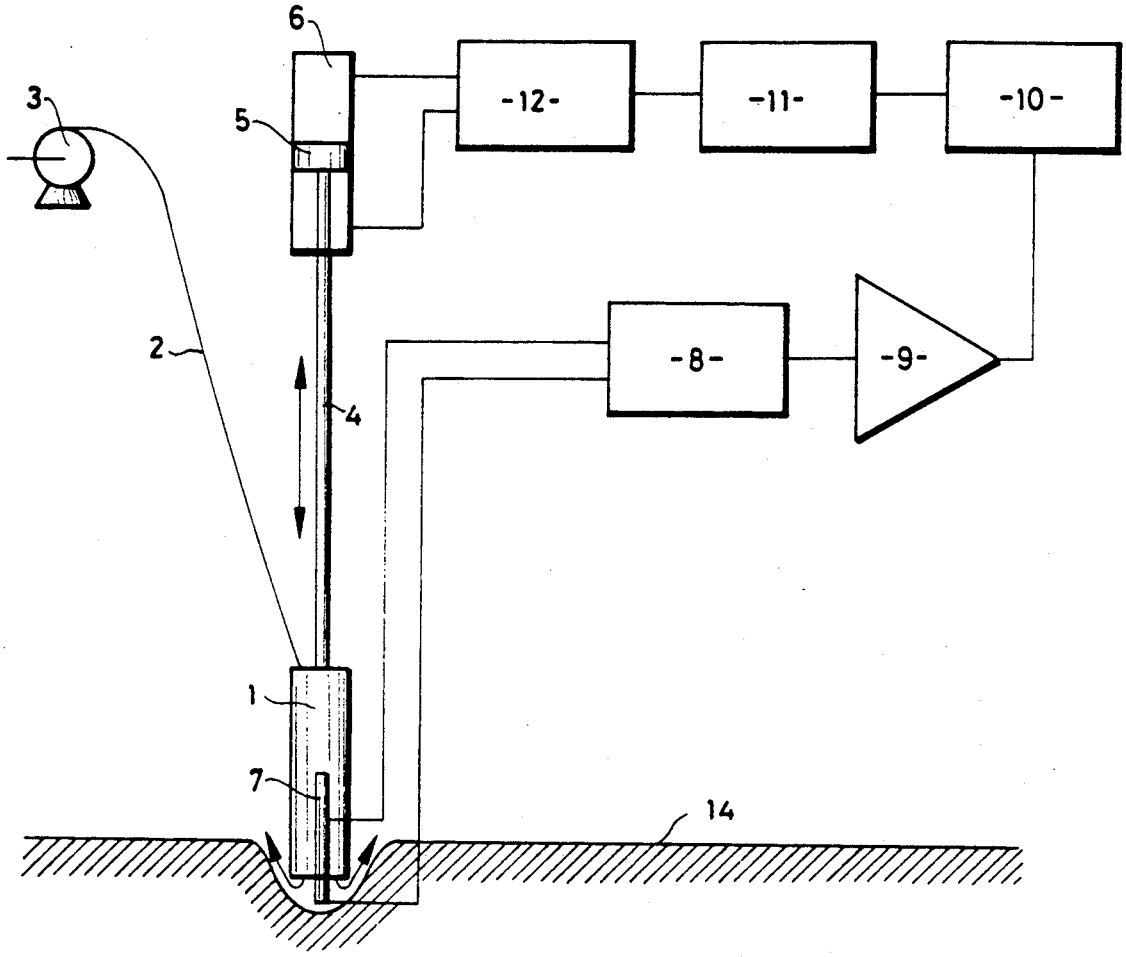
FIG. 1 shows a diagrammatic picture of a first embodiment of an erodability gauge.

The embodiment according to FIG. 1 comprises a spray lance 1 which is connected via a hosepipe 2 to the pressure side of a water pump 3. The lance 1 is initially situated with its downwardly facing spray nozzle at a short distance above the underwater floor. The lance is suspended by means of a rod 4 on the piston 5 of a hydraulic cylinder 6. Said cylinder 6 is attached to a carrier which is not shown. This may be a frame temporarily fixed on the floor or a floating pontoon. A floating body (for example a socalled remotely operated vehicle) which is kept in its position by means of dynamic positioning, and a trolley which travels over the floor and which is temporarily stationary are furthermore not excluded as a carrier. Attached to the spray lance 1 is a sensor 7 which forms part of a profile tracer, which is an apparatus which ensures that a constant distance is maintained between the spray nozzle of the lance and the underwater floor directly beneath the spray nozzle. The sensor is a bar having two electrodes and a common electrode. These are included in an electrical circuit of a detector. The electrical resistance (or conductivity) of the water is measured between the two small electrodes, which are fitted immediately above each other at the sensor position, and the common electrode. The level of the floor is measured by continuously comparing the resistance values, the position of the floor affecting the ratio of the resistances. This ratio is used in order to control a servo system in a manner such that a constant but adjustable distance of 0.5 to 2 mm is maintained between the sensor position and the level of the floor. The control mechanism for the spray lance comprises, in addition to the sensor 7 and the detector 8, a servo amplifier 9, a servo motor 10, a tachogenerator 11 and a hydraulic control valve unit 12. From the above it is evident that the hydraulic cylinder 6 is controlled in a manner such that the set electrical resistance ratio is always restored. The spray lance therefore descends into the small pit formed by the injected water with respect to the carrier in a manner such that the distance between the spray nozzle and the floor of the small pit remains essentially constant. This is a requirement for a good reproducibility of the measured erodability. Said erodability is derived from the relationship between the speed (mm/sec) with which the floor of the small pit descends and the flow rate ($m^3/h$) of the water flow which emerges from the spray lance and is directed at the soil.

Figure 2:
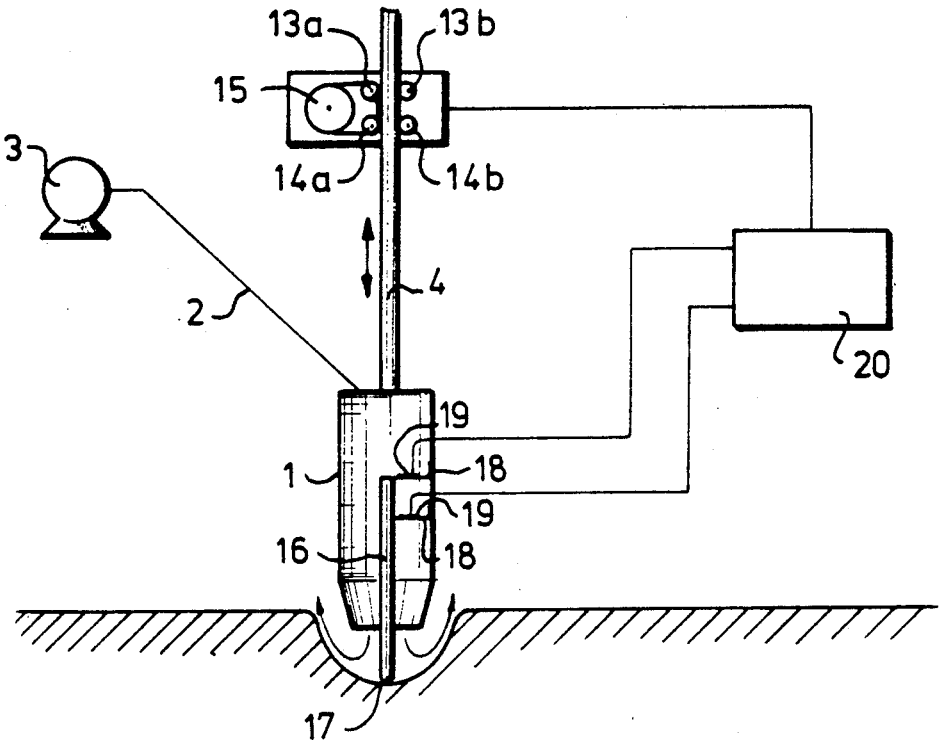
FIG. 2 shows a second embodiment of an erodability gauge.

The embodiment according to FIG. 1 may exhibit the disadvantage that the soil particles which swell up in the small pit make the measurement inaccurate. In many cases the embodiment according to FIG. 2 will therefore be preferred. This embodiment also has a spray nozzle which is connected via a hosepipe 2 to the pressure side of a water pump 3. The bar 4 may be displaced upwards and downwards by two pairs of wheels 13*a*, 13*b* and 14*a*, 14*b* which are driven by a motor via a toothed belt 15. The bar is clamped between the pairs of wheels 13, 14. A mechanical feeler bar 16, which is provided with a feeler surface 17 of arbitrary shape at its bottom end projects into the spray nozzle. Said surface acts on the floor. The bar 16 is attached to the spray nozzle by means of two leaf springs 18. Mounted on said springs is a strain gauge 19 which determines the state of tension of the springs. The strain gauges are connected by means of a control box 20 to a servo system which is able to regulate the motor for the wheels 13, 14 in a manner such that the tension in the leaf springs remains constant. The distance between the bottom end of the spray nozzle and the floor of the small pit formed therefore also remains constant.

Figure 4:
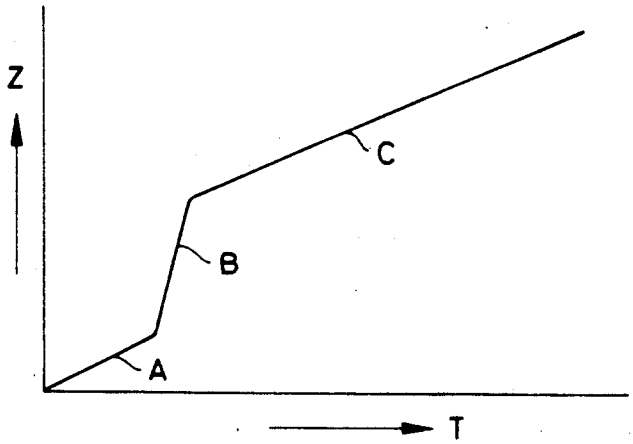
FIG. 4 shows a graphical reproduction of the relationship between the depth of the spray nozzle and the time for a particular soil sequence.

FIG. 4 shows the relationship between the depth z (millimeters) of the floor of the small eroding pit beneath the original underwater floor (for constant flow) and the time T (seconds) for a particular soil situation. The soil is layered, the first and the third layer (corresponding to A and C in FIG. 4) eroding with relative difficulty and a layer corresponding to B eroding easily. The erodability can be determined by determining dz/dT, which is the rate of descent at constant flow rate of the water flow.

The possibility is not excluded that the control of the movement of the spray lance is such that the latter descends at constant speed and that the varying flow rate (P) of the water flow associated therewith is measured. In that case, P is a measure of the erodability of the soil at various depths.

Figure 3:
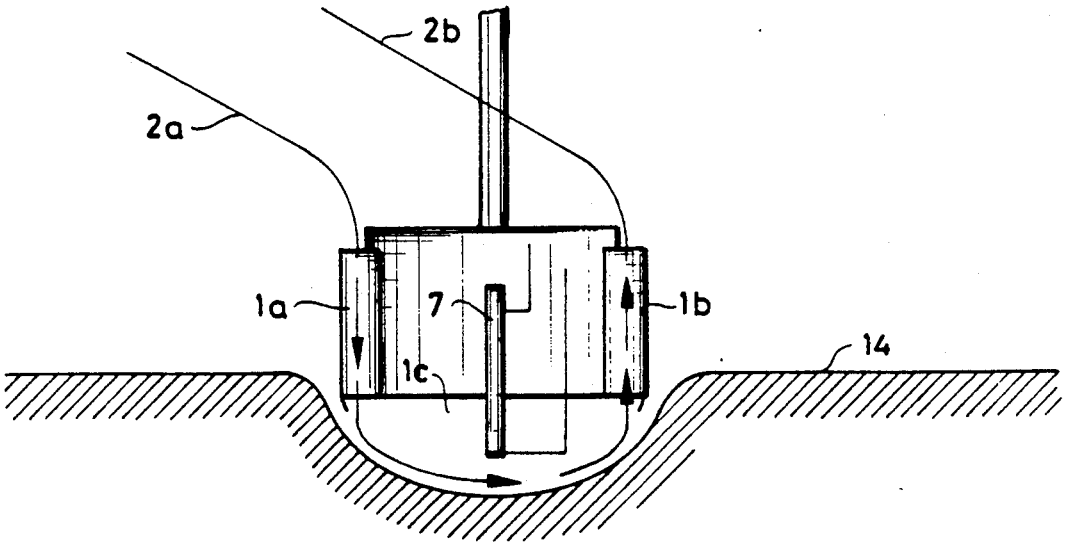
FIG. 3 shows an alternative embodiment of the spray nozzle according to FIG. 1.

The spray lance may also have the form according to FIG. 3, that is to say, comprising a vertical feed pipe 1*a* connected via a hosepipe 2*a* to the pressure side of a pump, a drainpipe 1*b* connected via a hosepipe 2*b* to the suction side of said pump and an open horizontal intermediate piece 1*c*. This embodiment has the advantage that the essentially horizontal water flow generated is more in accordance with the actual conditions which occur in the case of an offshore structure.

The spray lance can always be provided with turbulence-promoting devices.

In the embodiment of the water feed means according to FIG. 1, the deepening of the pit may be retarded by the movement of the sedimentary material which results in the pit being widened. This may result in a disturbing influence on the erosion process. All this could be counteracted by ensuring that all the material detached is removed. The embodiments of the spray lance according to FIGS. 5*a* to 5*c* make a contribution to this.

Figure 5A:
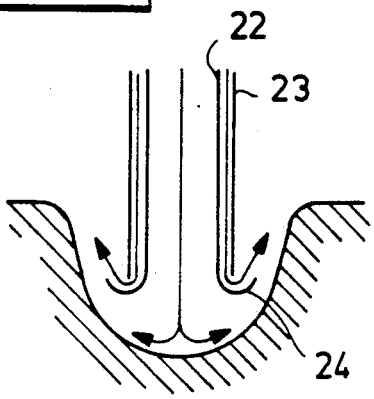
FIGS. 5*a* to 5*e* inclusive show a number of alternative embodiments of the spray nozzle.

In the embodiment according to FIG. 5*a*, the spray lance comprises two concentric tubes 22, 23. The innermost tube 22 extends by means of its lower rim past the lower rim of the outermost tube and is provided with an annular trough 24 at said lower rim. The water which is fed by the inner tube flows towards the floor of the pit and the water fed by the space between the tubes 22, 23 is deflected laterally upwards by means of the trough 24, as indicated by the arrows, to remove material from the side edges of the pit.

Figure 5B:
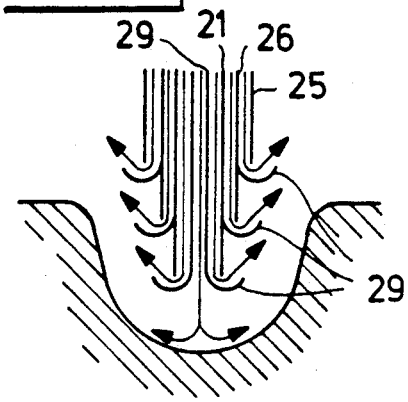

This principle is developed further in the embodiment according to FIG. 5*b*: here a spray lance is involved which has four concentric tubes 25 to 28 inclusive, the lower rims of which have a higher level going from the inside to the outside, the three innermost tubes being provided with a small annular trough 29, each at a short distance below the lower rim of the subsequent tube.

Figure 5C:
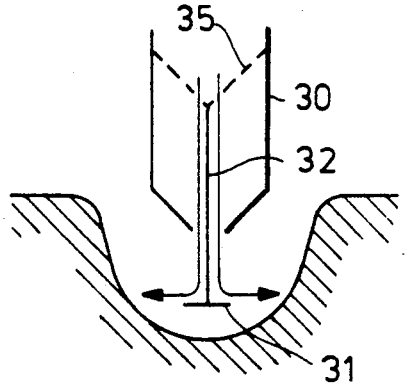

The spray lance according to FIG. 5*c* has, below the lower rim of the feed tube 30, a dish 31 which is attached by means of a bar 32 and spoke-like attachment bars 33 to the tube 30. The water acquires an essentially horizontal direction of flow. The formation of the small pit is then more in accordance with erosion as a consequence of horizontal flows. Furthermore, the dish 31 may be provided on its upper face with spiral vanes in order to increase the eroding power. The principle according to FIG. 5*c* may be combined with that according to FIG. 2, the feeler surface 17 fulfilling the function of dish 31.

Figure 5D:
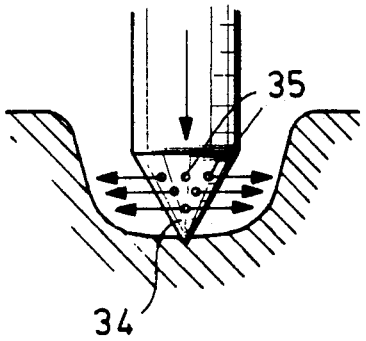

FIG. 5*d* shows an embodiment in which the bottom end of the spray lance has the form of a cone 34 having openings 35 which spread the water fed in in a horizontal direction. The apex of the cone should be located on or in the soil, the spray lance descending into the soil through its own weight and soil erosion; this could make an advanced control of the lance superfluous. However, a disadvantage is that the strength of the soil influences the position of the outflow openings with respect to the floor and thus the resulting speed of descent.

Figure 5E:
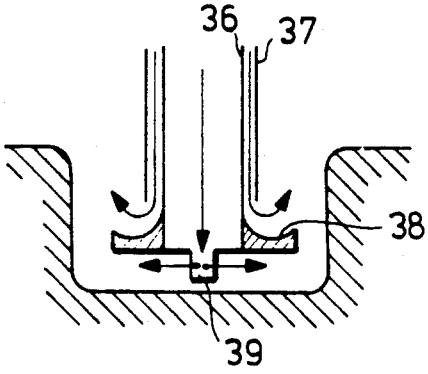

The embodiment according to FIG. 5*e* shows a spray lance according to FIG. 5*a* having two concentric tubes 36 and 37 and a small trough 38 and said lance is provided, in addition, with a spray nozzle 39 in which openings are provided for the horizontal spreading of the water fed in.

It will be clear that various modifications can be made within the scope of the invention. Essential to the invention is that erosion is generated in situ by means of a water flow from a spray nozzle, the distance between the bottom end of the spray nozzle and the floor of the small pit formed by erosion being kept constant because a sensor is fitted to the spray nozzle and this measures a quantity which is a function of the distance between the bottom end of the spray nozzle and the floor of the small pit, which quantity is used to regulate a servo system for controlling the displacement means of the spray nozzle.

We claim:

1. Process for determining the erodability of soil, in particular soil belonging to the underwater floor, comprising installing a vertically displaceable spray nozzle above the floor, producing a water flow onto or over the soil by means of said spray nozzle, which flow forms a pit in the soil by erosion of the soil, systematically lowering the spray nozzle by means of displacement means in a manner such that said nozzle follows the descending pit floor, determining the speed at which the spray nozzle follows the pit floor and deriving the erodability at various depths from the relationship between said speed and the flow rate of the water flow, characterized in that a quantity which is a function of the distance between the bottom end of the spray nozzle and the floor of the pit is measured with a sensor fitted to the spray nozzle, and in that said quantity is used to regulate a servo system which controls said displacement means of the spray nozzle in a manner such that said distance between the bottom end of the spray nozzle and the floor of the pit remains essentially constant.

2. Process according to claim 1, characterized in that the flow rate of the water flow through the spray nozzle is regulable.

3. Apparatus for determining the erodability of soil, in particular soil belonging to the underwater floor, according to the process according to claim 1 or 2, comprising a spray nozzle, displacement means for displacing the spray nozzle vertically, control means for systematically controlling the displacement means in a manner such that the spray nozzle is able to follow the descent of the floor and means for determining the speed at which the spray nozzle follows the descending floor, characterized in that a sensor for measuring a quantity which is a function of the distance between the bottom end of the spray nozzle and the floor of the pit is fitted to the spray nozzle, which sensor is connected to a servo system which is capable of controlling hydraulic or mechanical means for displacing a suspension bar of the spray nozzle in a manner such that the distance between the bottom end of the spray nozzle and the floor of the pit remains essentially constant.

4. Apparatus according to claim 3, characterized by means for measuring and regulating the flow rate of the water flow through the spray nozzle.

5. Apparatus according to claim 4, characterized in that said sensor comprises a mechanical feeler which projects displaceably into the spray nozzle and in that position-determining means project into the spray nozzle for determining the position of the feeler in the spray nozzle.

6. Apparatus according to claim 5, characterized in that the mechanical feeler is connected to the spray nozzle by springs and strain gauges are attached to these springs for determining the spring tension which is a function of the position of the feeler in the spray nozzle.

7. Apparatus according to claim 4, characterized in that said sensor is constructed in the form of a so-called dynamic profile tracer comprising a bar having two feeler electrodes sited at a short distance above one another and a common main electrode, means being present for determining the resistance value between the main electrode and the feeler electrodes.

8. Apparatus according to claim 3, characterized in that the spray nozzle is T-, L- or U-shaped and has a vertical water drain and an open horizontal intermediate section.

9. Apparatus according to claim 3, characterized in that the spray nozzle is provided with turbulence-promoting devices.

* * * * *

UNITED STATES PATENT AND TRADEMARK OFFICE

CERTIFICATE OF CORRECTION

PATENT NO. : 5,022,262

DATED : June 11, 1991

INVENTOR(S) : CORNELIS H. HULSBERGEN, ET AL.

It is certified that error appears in the above-identified patent and that said Letters Patent is hereby corrected as shown below:

Title page item no. [73] Assignees:

Please change "Cornelis H. Hulsbergen; Romke Bijker, both of Netherlands" to --Stichting "STICHTING WATERBOUWKUNDIG LABORATORIUM", the Netherlands--.

Signed and Sealed this

Twenty-seventh Day of October, 1992

*Attest:*

DOUGLAS B. COMER

*Attesting Officer*

*Acting Commissioner of Patents and Trademarks*